United States Patent [19]

Burmeister

[11] 3,942,659

[45] Mar. 9, 1976

[54] CRADLE HEARTH OVEN

[75] Inventor: Karl-Heinz Burmeister, Kleve, Germany

[73] Assignee: Ipsen Industries International Gesellschaft mit beschrankter Haftung, Kleve, Germany

[22] Filed: July 26, 1974

[21] Appl. No.: 492,207

[30] Foreign Application Priority Data

July 27, 1973 Germany ..... 2338204

[52] U.S. Cl. ..... 214/18 R; 198/218; 432/134

[51] Int. Cl.[2] ..... F27B 9/16

[58] Field of Search.. 214/18, 26; 198/218, 220 BA; 432/134

[56] References Cited

UNITED STATES PATENTS

| | | | |
|---|---|---|---|
| 1,695,950 | 12/1928 | Carpenter | 432/134 |
| 1,799,956 | 4/1931 | Cope | 432/134 |

*Primary Examiner*—Robert G. Sheridan

*Attorney, Agent, or Firm*—Joseph A. Geiger

[57] ABSTRACT

A cradle hearth oven for the heat treatment of parts, inside which is arranged an inclined rocking trough serving as a parts conveyor. The rocking trough is directly supported on the oven floor and the entire oven is tiltable to adjust the trough inclination.

12 Claims, 4 Drawing Figures

CRADLE HEARTH OVEN

BACKGROUND OF THE INVENTION

1. Field of the Invention

The present invention relates to ovens for heat treating manufactured parts, and in particular to ovens which are equipped with conveying means moving the parts through the oven chamber.

2. Description of the Prior Art

Various heat treatment ovens with conveying means are known. One such prior art oven is a so-called shaking hearth oven, having a shaking trough reaching through the oven chamber, the parts to be treated being loaded on one end of the trough and conveyed through the oven through the shaking action of the trough. This shaking conveyance is obtained through pulsing thrusts applied to the trough by means of a pneumatic cylinder. The shaking trough extends through the entire length of the oven, which may have one or two heating zones and which may be heated with gas or electrically.

Among the shortcomings of this prior art device are that the shaking trough and the parts to be treated must be protected against direct heat radiation in each oven zone by means of a muffle; that difficulties exist therefore in connection with the circulation of the oven atmosphere, so that the gas components necessary for the surface treatment of the parts come in contact with all parts surfaces and that the heat is distributed evenly; and that due to the pulsing thrusts applied to the shaking trough and the resulting impact stress, in combination with uneven heat distribution, buckling occurs on the shaking trough surface, with the result of impeded parts conveyance.

It has also been found that small parts, especially miniature parts and special parts, when treated in a shaking hearth installation, lead to damaging heat stress on the trough, because of their high bulk weight, resulting likewise in an impairment of the evenness of conveyance and of the quality of heat treatment.

SUMMARY OF THE INVENTION

Underlying the present invention is the objective of developing a heat treatment oven with an improved trough as a conveying means assuring an even, continuous movement of the parts to be treated through the oven chamber, where the trough itself is less subject to deformation, because of improved heat distribution, and where the heating conditions and the circulation of the oven atmosphere are likewise improved, so that more efficient heat transfer and a consistently high quality of heat treatment are obtained.

The present invention proposes to attain the above objective by suggesting a heat treatment oven with a conveying trough, in which the trough is designed as a cradle trough, or rocking trough, executing a rocking motion around a longitudinal axis, whereby the cradle is longitudinally slightly inclined, having a high point at the oven entrance and a low point at the oven exit. To obtain the inclination of the rocking trough, it is suggested that preferably the entire oven is mounted in an inclined orientation. This type of support is extremely simple, free of engineering problems, and very economical. The speed of parts conveyance through the oven chamber is determined by the angle of trough inclination and by the rocking frequency. The resulting movement of the manufactured parts is extremely smooth and free of shock and vibrations. The parts surfaces are fully accessible to the circulating atmosphere, because the novel rocking trough does not require a guide muffle, as a result of its rocking motion. The rocking action itself has the additional advantage that every rocking motion causes the parts load to change its position inside the oven chamber so that it is flowed through by the oven atmosphere and irradiated from alternatingly different directions. The result is an intensive and evenly distributed heating of the parts.

The shape of the rocking trough is preferably that of a drum segment. This shape decreases the sensitivity of the trough to heat stress. Cross-sectionally, the rocking trough should preferably have the shape of an ellipse with an open upper side, the aperture reaching approximately from a perpendicular plane through one ellipse focus to a similar perpendicular plane through the other ellipse focus. The remaining trough shape thus has an upwardly oriented ledge on each longitudinal side which, without effecting the operational characteristics of the rocking trough, greatly increases the parts carrying capacity of the trough.

The rocking motion for the trough can, of course, be provided in a variety of ways. It was found to be particularly advantageous to provide the bearing support for the rocking trough by attaching a cylindrical cradle arbor to the underside of the trough, thereby directly supporting the trough on the oven floor. The arbor then executes a cycloidal motion on the oven floor, the end positions of the rocking motion being determined by the points at which the trough borders contact the oven floor. The material of the oven floor, especially of the floor portion supporting the cradle arbor, should be hard stone. This arrangement has the advantage that the cradle is supported over its entire length, and that only negligible wear is caused by the limited rocking or rolling motion. The support of the trough over its entire length has the particular advantage that the trough cannot be deflected and deformed by its load, as was the case in the prior art shaking hearth oven, where a free space had to be provided under the shaking trough.

The end points of the rocking motion of the conveying trough may also be determined by special abutments provided in combination with the rocking drive and with the reversing mechanism of the drive. The particular mode and size of the rocking drive has to be choosen in accordance with the specific requirements of the installation involved. Thus, the drive may be provided pneumatically or hydraulically, with a double-acting rocking cylinder, or it may be provided mechanically through reciprocating gears, or a rotary drive with a crank.

In order to provide adjustability of the speed of conveyance, by taking advantage of the influence of the trough inclination and rocking frequency on the conveyance speed, the invention further suggests a simple means for adjusting the trough inclination. This is preferably accomplished by providing an adjustable inclination of the entire oven on the floor of which the rocking cradle hearth is supported. This adjustability of the inclination to any desired angle, even during operation, permits a convenient adaptation of the device to the weight and required treatment duration of the manufactured parts, by permitting a precise setting of the optimal speed of conveyance. For average conditions, where small parts or minature parts are to be heat treated in the oven, the optimal oven inclination will normally lie somewhere between 2 and 4 percent.

For an optimal operation of the novel cradle hearth oven, it is recommended that the maximum length of the manufactured parts be less than one-sixth of the width of the trough. On the loading end the rocking trough is preferably provided with baffle panels. Furthermore, the initial length portion of the trough at its loading end may have recessed overflow edges, permitting excess parts to be discharged from the trough and to be returned to the feeding device through an overflow chute. This arrangement has the advantage of preventing any overloading of the trough, while making it possible to always operate the latter at optimal efficiency. As the cradle hearth is rocked back and forth, the manufactured parts travel longitudinally through the oven chamber until they reach the discharge chute at the lower end of the cradle hearth through which they exit from the oven, preferably directly into a quenching tank. This arrangement represents a still further advantage of the invention, inasmuch as the aperture of the discharge chute can be kept minimal in size, because of the regularity of parts discharge, so that both the loss of radiation heat and the entry of steam from the quenching tank are minimized.

In operation, the novel heat treatment oven was found to require minimal supervision and to have a high operational efficiency in terms of output and energy consumption. Any accumulations of parts on the loading side of the trough are quickly dissipated, after only a few rocking motions of the trough. The entire conveying motion is extremely even and regular. Even spherical parts lend themselves well for this type of conveyance. The parts which are to be treated are handled gently and are treated evenly. The circulation of the oven atmosphere is considerably improved through the particular rocking orientations of the trough, no guide muffle being necessary. Because the orientation of the parts under treatment changes after each rocking motion, the parts accumulation is flowed through by the gas alternatingly from different directions and all surfaces of the parts are irradiated. The resultant through-heating is extremely even and efficient. The rocking trough itself is subjected to far less heat stress than known prior art conveying troughs, eliminating the previously encountered risks of buckling and blister formation. Lastly, the trough structure is no longer subjected to impact stress and, because of its continuous support on the oven floor, can be made less heavy.

The disclosed novel conveyance by means of a rocking trough is also conveniently applicable in other conveying situations, especially where environmental conditions make other conveying means subject to operational problems, and where a simple adjustment of the conveying speed is desired. Such applications are particularly useful in connection with washing troughs for heavily soiled parts, dosing troughs for bulk material, further as a substitute for vibrating troughs on supply bunkers, and as a feed trough in conjunction with conveyor ovens, for example, for the continuous loading of material charges under even distribution over the conveyor width, and others more.

BRIEF DESCRIPTION OF THE DRAWINGS

Further special features and advantages of the invention will become apparent from the description following below, when taken together with the accompanying drawings which illustrate, by way of example, an embodiment of the invention, represented in the various figures as follows.

DESCRIPTION OF THE PREFERRED EMBODIMENT

Figure 1:
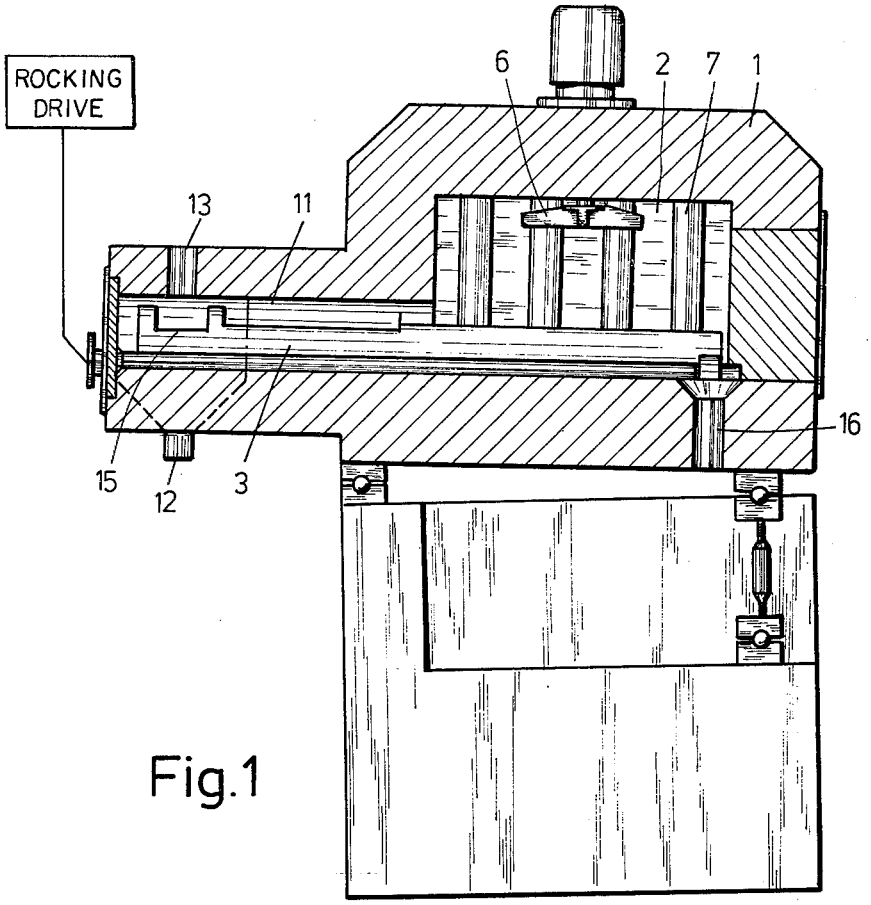
FIG. 1 shows in a longitudinally cross-sectioned elevation a cradle hearth oven embodying the invention.

In its basic conception, the cradle hearth 1 of the invention, as illustrated in the drawing, is comparable to a known shaking hearth oven with a shaking trough. The general operational details of the novel oven are therefore not specifically described in this disclosure.

The oven 1 of FIG. 1 has an oven chamber 2 inside which the heat treatment of the manufactured parts 4 (FIG. 3) is performed. The parts 4 reach the oven chamber 2 from an oven antechamber 11 where the parts entry into the oven takes place. The supply of parts to the oven may be provided in a known manner, as, for example, with the help of a vibrating conveyor which feeds the parts from a chute, under the dosage control of a baffle, to a conveyor belt, whose speed of rotation is adjusted as a function of the oven operating speed. Through a loading funnel (not shown), whose clappet automatically opens at predetermined time intervals, the manufactured parts then slide into the oven antechamber 11, via an entry chute 13, to be deposited on the upper end, or loading end of a rocking trough 3. This trough 3 extends longitudinally through the entire antechamber 11 and through the treatment chamber 12 of the oven, reaching from the loading end of the oven to its opposite discharge end, the trough having an adjustable inclination between 2 and 4 percent.

Figure 2:
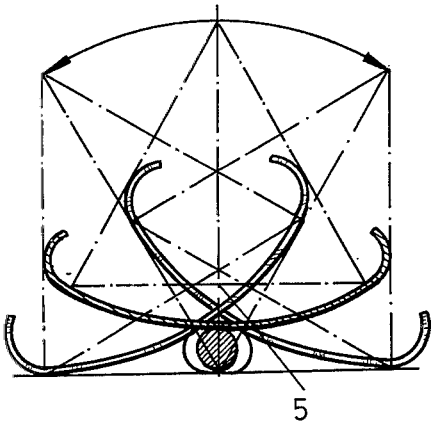
FIG. 2 illustrates schematically the rocking motions of the trough of the oven in FIG. 1.
Figure 3:
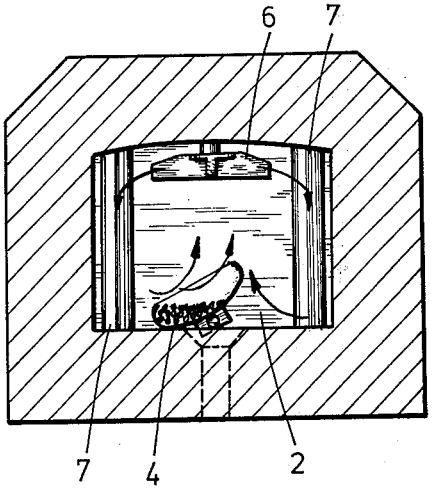
FIG. 3 is a transverse elevational cross section through the treatment chamber of the oven of FIG. 1.
Figure 4:
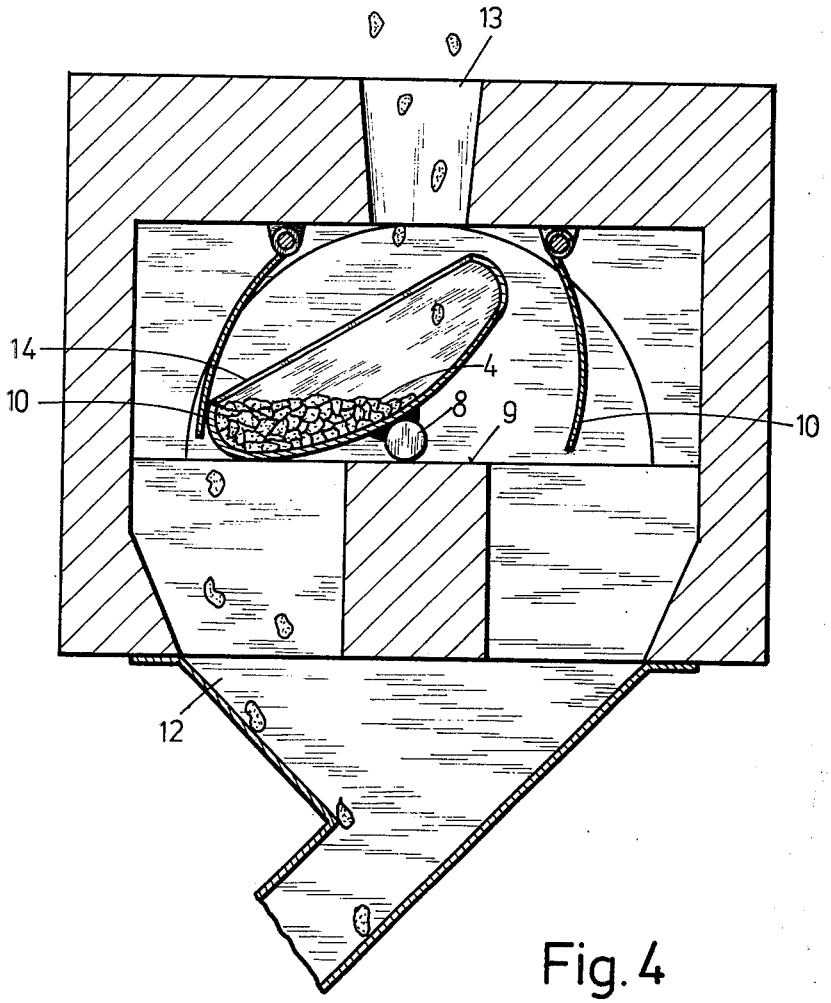
FIG. 4 is an enlarged elevational cross section of the antechamber of the oven of FIG. 1.

In its outline, the rocking trough 3 represents a segment of a drum of cross-sectionally approximately elliptical shape, as can be seen in FIGS. 2, 3 and 4. This rocking trough 3 has an aperture 14 on its upper side in at least its length portions located under the loading chute 13 and in the heated oven chamber 2, the aperture 14 being so designed that, even in its tilted end positions, a safe loading of the trough 3 through the chute 13 is assured, as is best seen in FIG. 4.

The rocking trough 3 is arranged for a bilateral rocking motion around its longitudinal axis 5, so that the manufactured parts 4 slide from side to side on the rocking trough 3, while at the same time moving longitudinally through the oven 1, in accordance with the trough inclination. Thus, the rate of longitudinal advance of the parts 4 through the oven is determined by the combination of the trough inclination and the rocking frequency, with the rocking amplitude being unchanged.

The rocking trough 3 is supported over its entire length directly on the oven floor 9, by means of a cradle arbor 8 attached to the underside of the trough 3, in central longitudinal alignment therewith. The oven floor 9 on which the arbor 8 is supported is preferably of hard stone. Thus, the cradle arbor 8 executes a rolling motion on the oven floor 9 (see (FIG. 2).

As can be seen in FIG. 4, the loading zone of the cradle hearth further includes laterally arranged pivotable baffle panels 10 on each side of the trough 3. The baffle panels 10 engage the overflow edges of the trough 3, when they are in their low position, overflowing parts falling through an overflow chute 12 onto a return conveyor (not shown), which returns them to the supply funnel. The parts to be treated, once deposited on the rocking trough 3, advance in a smooth zigzag motion toward the oven chamber 2 where they are intensely flushed by the gases constituting the oven atmosphere. The rocking trough 3, in cooperation with an overhead ventilator 6, produce this flushing action, as indicated by the arrows in FIG. 3. The treatment heat in the oven chamber 2 is provided by the heaters 7.

When the treated parts reach the lower end of the rocking trough 3, they are discharged into the discharge chute 16, through which they fall directly into a quenching bath (not shown).

FIG. 2 of the drawing illustrates schematically the rocking motions of the trough 3. A suitable drive causes the cradle arbor 8 to execute a rolling motion on the oven floor 9, moving laterally in both directions from a central position, until the edge portion of the trough profile abuts against the oven floor 9. The two end positions of this rocking motion are indicated in FIG. 2 by thin lines. The total angle of the rocking motion, in reference to the support point between the arbor 8 and the floor 9, is indicated by the arching arrow of FIG. 2.

The shape of the rocking trough 3 is elliptical, as approximated by pairs of large and small radii, one large radius defining the bottom of the trough, while the two small radii form the trough sides. As FIG. 2 indicates, the aperture of the trough corresponds substantially to the length of the second large radius. The ratio between the large and small radii should be at least five, and is preferably in the vicinity of ten.

It should be understood, of course, that the foregoing disclosure describes only a preferred embodiment of the invention and that it is intended to cover all changes and modifications of this example of the invention which fall within the scope of the appended claims.

I claim:

1. In an oven for the heat treatment of parts inside an oven chamber, a parts conveying device comprising in combination:

an elongated trough extending longitudinally through the oven chamber at a slight incline, the trough thus having an elevated loading end and a lowered discharge end;

bearing means for rotatably supporting the trough in such a way that it can execute a rocking motion about a central longitudinal rocking axis;

drive means for imparting to the trough a reciprocating rocking motion, thereby alternately moving the trough from a median orientation, in which the trough is in approximate balance with respect to its rocking axis, to either side thereof;

means for supplying treatable parts to the loading end of the trough from above the latter;

means for discharging the treated parts at the discharge end of the trough; and a pair of laterally pivotable baffle panels arranged in the area of the loading end of the trough on either side thereof, the panels having a longitudinal pivot axis on their upper ends and engaging alternatingly that lateral extremity of the trough which is lowered in the rocking motion.

2. A parts conveying device as defined in claim 1, further comprising means for adjusting the trough inclination.

3. A parts conveying device as defined in claim 2, wherein the longitudinal inclination of the trough is adjusted preferably between 2 and 4 percent inclination.

4. A parts conveying device as defined in claim 2, wherein:

the bearing means for the trough is defined by the oven structure; and the inclination adjusting means is a means for adjusting the longitudinal inclination of the oven itself.

5. A parts conveying device as defined in claim 1, wherein:

the bearing means for the trough includes a longitudinal cradle arbor underneath the trough, the axis of the arbor being in vertical alignment with its rocking axis; and the oven has a flat, inclined oven floor against which said arbor is supported on its circumference, over at least a major portion of its length.

6. A parts conveying device as defined in claim 5, wherein:

the cradle arbor is fixedly attached to the underside of the trough;

the oven floor is composed of pressure resistant hard stone; and the rocking motion is a cycloidal motion, generated by the arbor rolling from side to side on the oven floor.

7. A parts conveying device as defined in claim 1, wherein the trough has the general shape of a drum segment which is open on its upper side, and which has a cross-sectional outline of smooth curvature.

8. A parts conveying device as defined in claim 7, wherein the cross-sectional outline of the trough is derived from an ellipse, whose major diameter is horizontal in the median orientation of the trough, the trough aperture, or missing portion of the ellipse being that portion of its upper arch which is comprised between two vertical planes extending through the two foci of the ellipse.

9. A parts conveying device as defined in claim 7, wherein the cross-sectional inside curvature of the trough is composed of one large arc and two small arcs, approximating an ellipse whose major diameter is horizontal in the median orientation of the trough and at least twice as large as its minor diameter, the missing second large arc defining the trough aperture.

10. A parts conveying device as defined in claim 9, wherein:

the two small arcs of the trough profile, defining upstanding ledges which serve to retain the parts inside the trough during its rocking motion, are partially cut away in the area of the loading end of the trough, so as to allow excess parts to flow over the ledges in this area.

11. In an oven for the heat treatment of parts inside an oven chamber, a parts conveying device comprising in combination:

an elongated trough extending longitudinally through the oven chamber at a slight incline, the trough thus presenting an elevated loading end and a lowered discharge end;

bearing means for rotatably supporting the trough in such a way that it can execute a rocking motion about a central longitudinal axis;

drive means for imparting to the trough said rocking motion, thereby rocking it from side to side;

means for supplying treatable parts to the loading end of the trough from above the latter; and means for discharging the treated parts at the discharge end of the trough; and wherein the cross-sectional outline of the interior trough wall is substantially elliptical, as approximated by pairs of large and small radii, one large radius defining the trough bottom outline, and the two small radii defining the outlines of laterally spaced, upstanding and inwardly overhanging trough sides.

12. A parts conveying device as defined in claim 11, wherein the ratio between the large and small radii of the interior trough outline is at least five; and the trough opening, or missing portion of the elliptical outline, corresponds substantially to the length of the second large radius.

* * * * *